US007385615B2

(12) United States Patent
Vale et al.

(10) Patent No.: US 7,385,615 B2
(45) Date of Patent: Jun. 10, 2008

(54) SYSTEM AND METHOD FOR SCALING IMAGES TO FIT A SCREEN ON A MOBILE DEVICE ACCORDING TO A NON-LINEAR SCALE FACTOR

(75) Inventors: Peter Ormand Vale, Seattle, WA (US); Jay Franklin McLain, Woodinville, WA (US); Andrew Dadi, Carnation, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 10/404,209

(22) Filed: Mar. 31, 2003

(65) Prior Publication Data

US 2004/0075671 A1 Apr. 22, 2004

Related U.S. Application Data

(60) Provisional application No. 60/420,475, filed on Oct. 21, 2002.

(51) Int. Cl.
*G09G 5/00* (2006.01)

(52) U.S. Cl. ..... 345/660; 345/581; 345/441; 345/629; 701/208

(58) Field of Classification Search ..... 345/660–661, 345/622, 620, 628, 858, 169, 964, 441, 581, 345/606, 629; 701/208
See application file for complete search history.

(56) References Cited

U.S. PATENT DOCUMENTS

| | | | | |
|---|---|---|---|---|
| 5,657,435 | A * | 8/1997 | Watters et al. | 345/441 |
| 5,751,283 | A * | 5/1998 | Smith | 715/798 |
| 6,178,272 | B1 * | 1/2001 | Segman | 382/298 |
| 6,346,950 | B1 * | 2/2002 | Jouppi | 345/660 |
| 6,473,609 | B1 * | 10/2002 | Schwartz et al. | 455/406 |
| 6,535,233 | B1 * | 3/2003 | Smith | 715/856 |
| 6,684,087 | B1 * | 1/2004 | Yu et al. | 455/566 |
| 6,697,734 | B1 * | 2/2004 | Suomela | 701/212 |
| 6,727,908 | B1 * | 4/2004 | Wright et al. | 345/606 |
| 6,853,912 | B2 * | 2/2005 | Han | 701/208 |
| 2002/0091738 | A1 * | 7/2002 | Rohrabaugh et al. | 707/517 |

* cited by examiner

*Primary Examiner*—Jin-Cheng Wang
(74) *Attorney, Agent, or Firm*—Merchant & Gould P.C.; Ryan T. Grace

(57) ABSTRACT

A system and method for scaling images to fit a screen on a mobile device. The images are scaled according to a non-linear scale factor to increase usability of the images. The larger images are scaled more aggressively than the smaller images according to the non-linear scale factor such that the images are viewed at a maximum size while fitting the images within the screen width.

15 Claims, 6 Drawing Sheets

500
SCALE FACTOR (%)
100
80
60
40
20
0
100
200
300
400
500
600
700
INITIAL WIDTH (PIXELS)

600
SCALED WIDTH (PIXELS)
200
150
100
50
0
100
200
300
400
500
600
700
INITIAL WIDTH (PIXELS)

SYSTEM AND METHOD FOR SCALING IMAGES TO FIT A SCREEN ON A MOBILE DEVICE ACCORDING TO A NON-LINEAR SCALE FACTOR

RELATED APPLICATIONS

This application claims the benefit of U.S. Provisional Application No. 60/420,475 filed on Oct. 21, 2002, which is hereby claimed under 35 U.S.C. §119(e).

FIELD OF THE INVENTION

The present invention relates generally to mobile computing, and more particularly to scaling images to fit a screen on a mobile device.

BACKGROUND OF THE INVENTION

Small, mobile computing devices such as personal desktop assistants, including hand-held and pocket-sized computers, tablet personal computers and the like, are becoming important and popular user tools. In general, they have become small enough to be extremely convenient, while consuming less battery power, and at the same time have become capable of running more powerful applications. Although the computing circuitry of such devices continues to shrink in size, the area available for displaying data to a user shrinks as well. The usability of such data may be problematic due to the relatively small size of the display.

For example, data is often displayed in the form of a "web page" that includes text, tables, images, and other varieties of display information. The images on a web page are optimized to be displayed on a screen having a specified minimum size. When the size of the screen available is smaller than the specified minimum size, such as on a mobile device, the mobile device may be unable to show the images in a size readily viewable by a user.

SUMMARY OF THE INVENTION

The present invention is directed to a system and method for scaling images to fit a screen on a mobile device. A non-linear scale factor is utilized to scale larger images of a page of data more aggressively than smaller images on the same page. Accordingly, the relative differences in sizes of the images on the page are reduced. In one embodiment, the aspect ratios of the images are held constant when scaling, so both height and width are scaled equally. The present invention avoids scaling the images of a page according to a linear scale factor. A linear scale factor may reduce a small image to a size that is unusable for its intended purpose. The present invention scales the images according to a non-linear scale factor to increase usability of the images.

According to a further aspect of the present invention, the non-linear scale factor is adjusted for a selected zoom setting when a zoom feature is associated with the mobile device. For the smallest zoom setting, images are scaled more aggressively to fit more content on the screen. Conversely, for the largest zoom setting, the images are scaled to a lesser extent to increase the detail of the image.

DESCRIPTION OF THE PREFERRED EMBODIMENT

Briefly stated, the present invention is directed at scaling an image provided to a mobile device to fit a screen associated with the mobile device according to a non-linear scale factor. These and other aspects of the invention will become apparent to those skilled in the art after reading the following detailed description.

Illustrative Operating Environment

Figure 1:
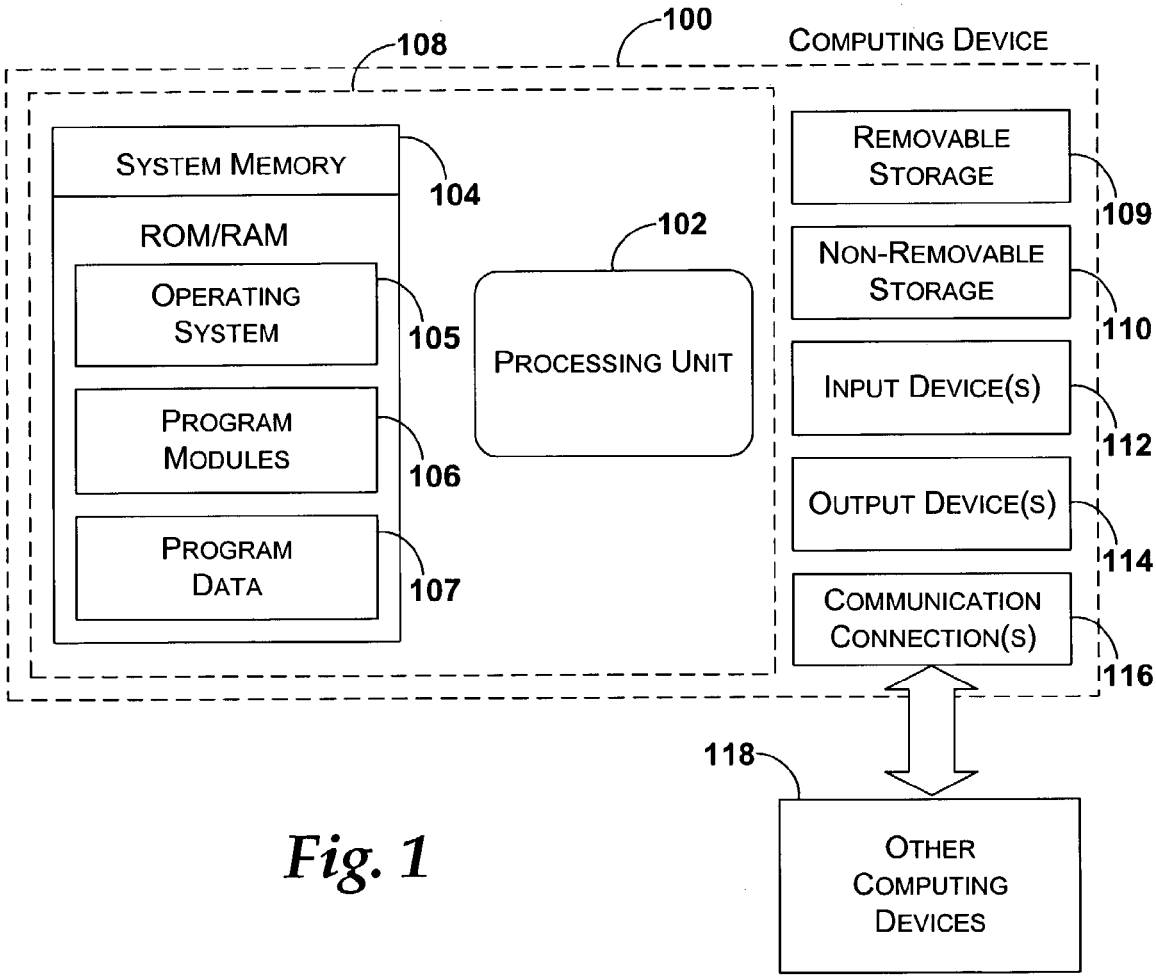
FIG. 1 illustrates an exemplary computing device that may be used in one exemplary embodiment of the present invention.

With reference to FIG. 1, one exemplary system for implementing the invention includes a computing device that may be configured to operate as a mobile device, such as computing device 100. In a very basic configuration, computing device 100 typically includes at least one processing unit 102 and system memory 104. Depending on the exact configuration and type of computing device, system memory 104 may be volatile (such as RAM), non-volatile (such as ROM, flash memory, etc.) or some combination of the two. System memory 104 typically includes an operating system 105, one or more program modules 106, and may include program data 107. This basic configuration is illustrated in FIG. 1 by those components within dashed line 108.

Computing device 100 may have additional features or functionality. For example, computing device 100 may also include additional data storage devices (removable and/or non-removable) such as, for example, magnetic disks, optical disks, or tape. Such additional storage is illustrated in FIG. 1 by removable storage 109 and non-removable storage 110. Computer storage media may include volatile and nonvolatile, removable and non-removable media implemented in any method or technology for storage of information, such as computer readable instructions, data structures, program modules, or other data. System memory 104, removable storage 109 and non-removable storage 110 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 100. Any such computer storage media may be part of device 100. Computing device 100 may also have input device(s) 112 such as keyboard, mouse, pen, voice input device, touch input device, etc. Output device(s) 114 such as a display, speakers, printer, etc. may also be included. These devices are well known in the art and need not be discussed at length here.

Computing device 100 may also contain communication connections 116 that allow the device to communicate with other computing devices 118, such as over a network.

Communication connections 116 are one example of communication media. Communication media may typically be embodied by computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

Figure 2:
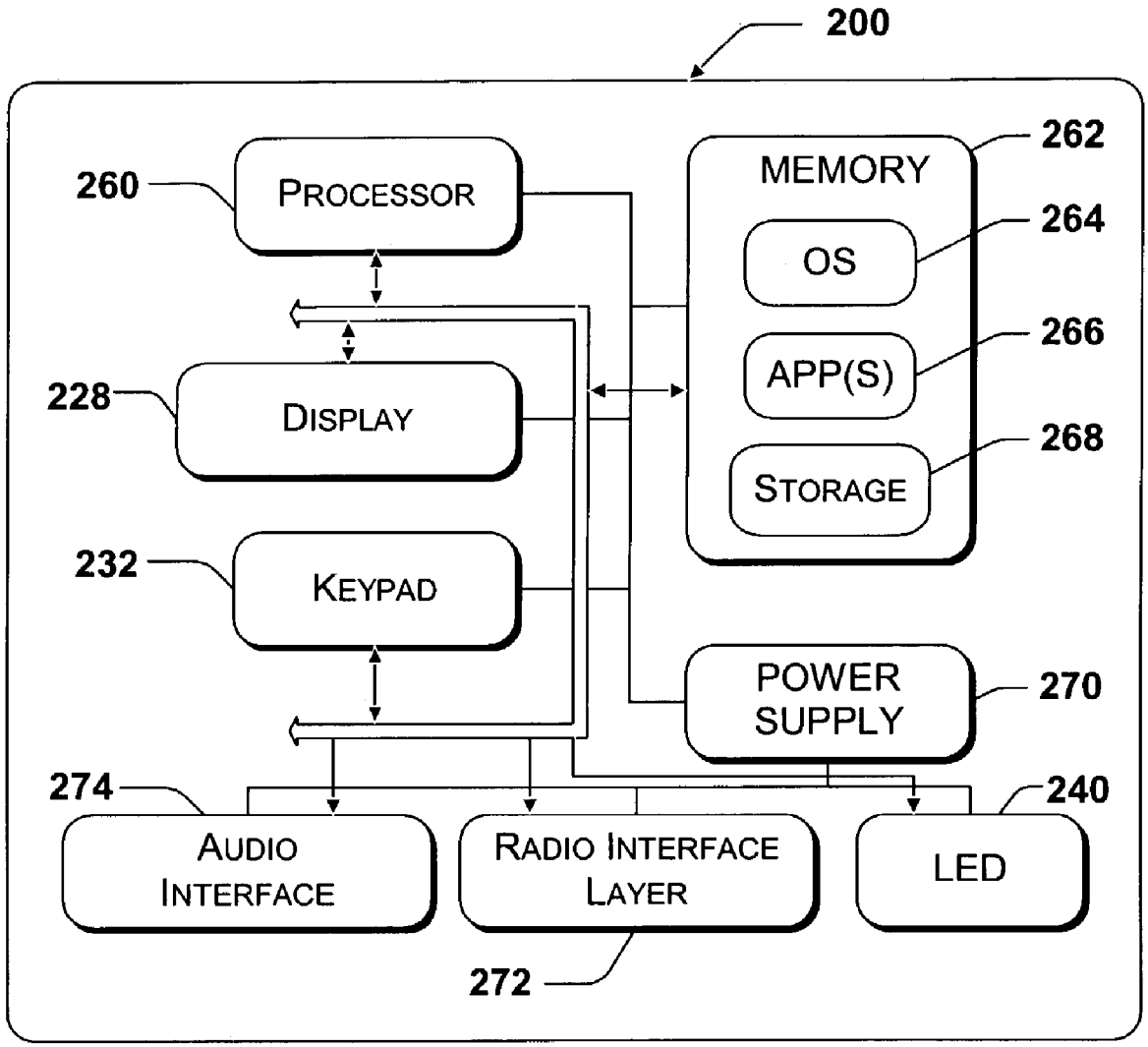
FIG. 2 illustrates an exemplary mobile device that may be used in one exemplary embodiment of the present invention.

With reference to FIG. 2, one exemplary system for implementing the invention includes a computing device configured as a mobile device, such as mobile device 200. The mobile device 200 has a processor 260, a memory 262, a display 228, and a keypad 232. The memory 262 generally includes both volatile memory (e.g., RAM) and non-volatile memory (e.g., ROM, Flash Memory, or the like). The mobile device 200 includes an operating system 264, such as the Windows CE operating system from Microsoft Corporation or other operating system, which is resident in the memory 262 and executes on the processor 260. The keypad 232 may be a push button numeric dialing pad (such as on a typical telephone), a multi-key keyboard (such as a conventional keyboard). The display 228 may be a liquid crystal display, or any other type of display commonly used in mobile devices. The display 228 may be touch-sensitive, and would then also act as an input device. The peripheral device port 230 may be of the type to accept additional memory cards, game cards, modem cards, or other peripheral devices.

One or more application programs 266 are loaded into memory 262 and run on the operating system 264. Examples of application programs include phone dialer programs, installation wizard programs, email programs, scheduling programs, PIM (personal information management) programs, word processing programs, spreadsheet programs, Internet browser programs, image scaling programs, and so forth. The mobile computing device 200 also includes non-volatile storage 268 within the memory 262. The non-volatile storage 268 may be used to store persistent information which should not be lost if the mobile computing device 200 is powered down. The applications 266 may use and store information in the storage 268, such as e-mail or other messages used by an e-mail application, contact information used by a PIM, appointment information used by a scheduling program, documents used by a word processing program, device driver programs, and the like.

The mobile computing device 200 has a power supply 270, which may be implemented as one or more batteries. The power supply 270 might further include an external power source, such as an AC adapter or a powered docking cradle, that supplements or recharges the batteries.

The mobile computing device 200 is also shown with two types of external notification mechanisms: an LED 240 and an audio interface 274. These devices may be directly coupled to the power supply 270 so that when activated, they remain on for a duration dictated by the notification mechanism even though the processor 260 and other components might shut down to conserve battery power. The LED 240 may be programmed to remain on indefinitely until the user takes action to indicate the powered-on status of the device. The audio interface 274 is used to provide audible signals to and receive audible signals from the user. For example, the audio interface 274 may be coupled to a speaker for providing audible output and to a microphone for receiving audible input, such as to facilitate a telephone conversation.

The mobile computing device 200 also includes a radio interface layer 272 that performs the function of transmitting and receiving radio frequency communications. The radio interface layer 272 facilitates wireless connectivity between the mobile computing device 200 and the outside world, via a communications carrier or service provider. Transmissions to and from the radio interface layer 272 are conducted under control of the operating system 264. In other words, communications received by the radio interface layer 272 may be disseminated to application programs 266 via the operating system 264, and vice versa.

Illustrative Process for Image Scaling

The present invention provides a system and method for scaling images according to a non-linear scale factor such that usability of the images is maximized. Usability of the images refers to the ability of a user to readily view and recognize the content of an image displayed. The nonlinear scale factor is used to scale larger images within a page of data more aggressively than smaller images. The variation in image sizes may be very common in content such as web pages or other loadable data pages. For example, a small image (e.g. 10 pixels wide) and a large image (e.g. 400 pixels wide) may be present on the same page. The screen on a mobile device may be only 200 pixels wide. The present invention maximizes the usability of the images by scaling the larger image to fit within the width of the screen, while minimizing the scaling of the smaller image or avoiding scaling the small image completely. In contrast, scaling all images according to a linear scale factor of 50% would result in a large image 200 pixels wide and the small image only 5 pixels wide. On a small display, attempting to see detail in an image that has been shrunk from 10 to 5 pixels in width may significantly reduce the usability of the image. With the present invention, the size of the smaller image is substantially maintained such that usability of the image is maximized.

Figure 3:
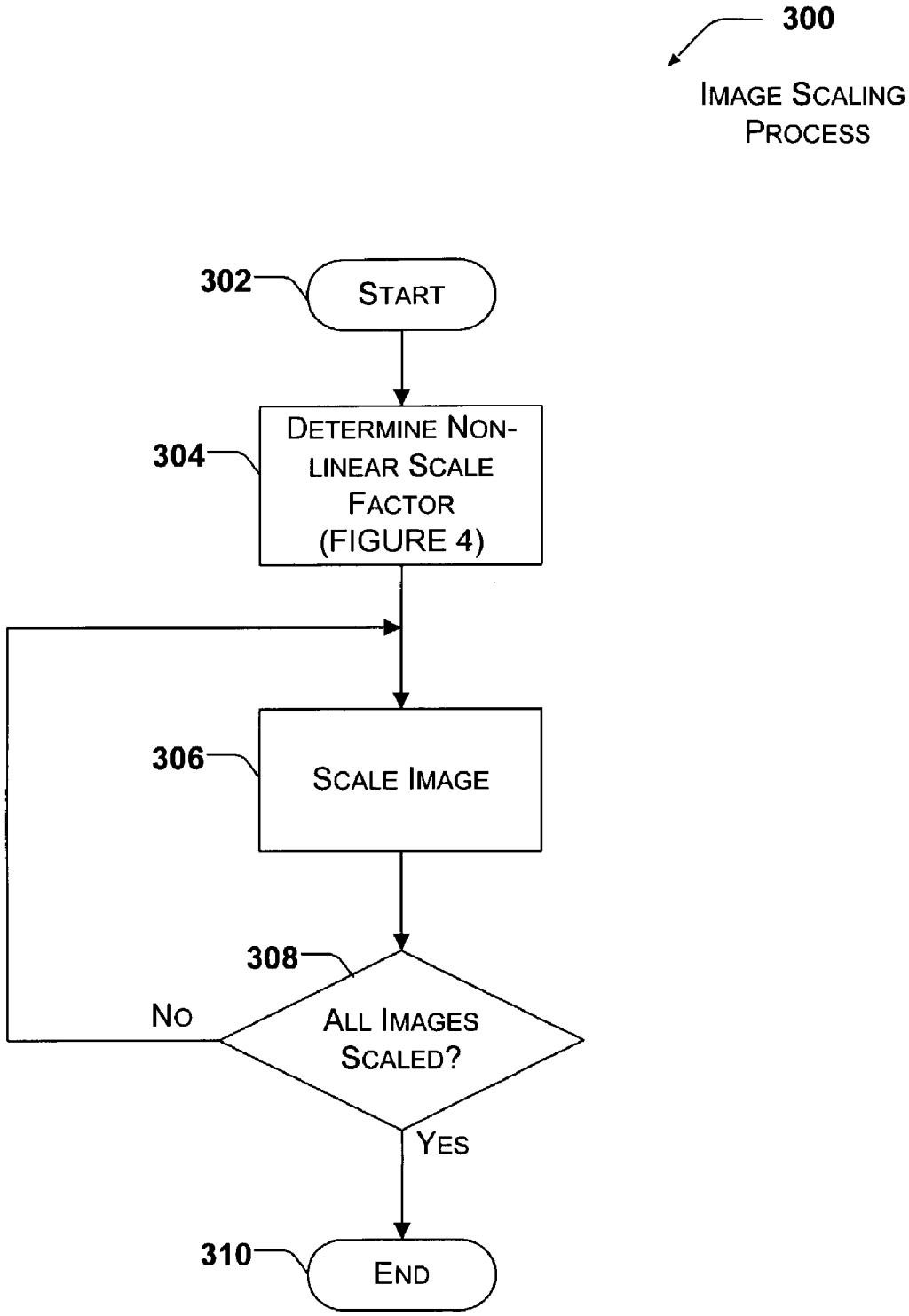
FIG. 3 is a logical flow diagram of an exemplary image scaling process according to the present invention.

FIG. 3 is a logical flow diagram of an exemplary image scaling process according to the present invention. The process 300 begins at start block 302 where the mobile device is powered on and has received a page or other data to display on the mobile device. The page or other data includes one or more images that have been located on the page. In one embodiment, the page is a web page that is written according to a standard such as HTML, XHTML, CSS, or the like. The process 300 continues at block 304.

At block 304, the non-linear scale factor for application to the images located on the page of data is determined. In one embodiment, the non-linear scale factor for the images is dependant on the width of the screen on the mobile device. In another embodiment, the non-linear scale factor is dependent on whether a zoom feature is associated with the mobile device. An illustrative process for determining the non-linear scale factor is further described in the discussion of FIG. 4 below. Once the non-linear scale factor for the images located on the page is determined, processing proceeds to block 306.

At block 306, an image associated with the page of data is scaled according to the determined non-linear scale factor. In one embodiment, the images are scaled such the largest figure is scaled according to the width of the mobile device. Accordingly, a user of the mobile device may view the images without the need to scroll the page of data horizontally. In this embodiment, the width of each image fits within the width of the screen on the mobile device. In another embodiment, certain images associated with the page of data are not scaled. An image may not be scaled when scaling of the image is not required to fit the image within the screen of the mobile device. In another embodiment, an image may not be scaled if it would reduce the usability of the image beyond a predetermined level. Processing continues at block 308.

At decision block 308, a determination is made whether all of the images associated with the page of data have been scaled according to the non-linear scale factor. If not all of the images have been scaled, processing returns to block 306 to continue scaling process 300. However, if all of the images associated with the page of data have been scaled, processing moves to block 310, where processingends.

Figure 4:
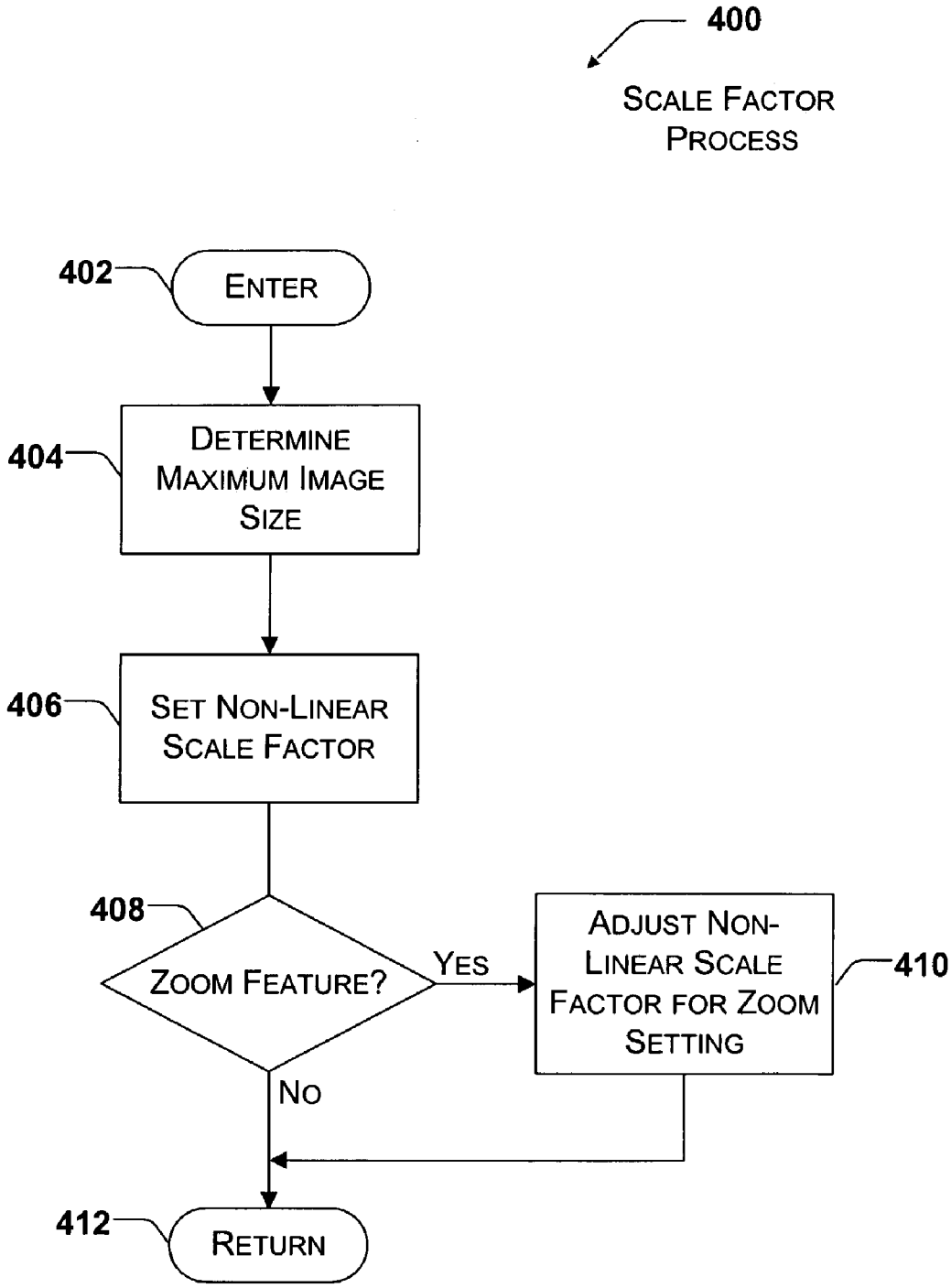
FIG. 4 is a logical flow diagram of an exemplary scale factor determination process according to the present invention.

FIG. 4 is a logical flow diagram of an exemplary scale factor determination process according to the present invention. The process 400 enters at block 402 when process 300 shown in FIG. 3 enters block 304. The process 400 continues at block 404.

At block 404, the maximum image size associated with the page of data is determined. In one embodiment, the maximum image size is limited according to the width of the screen on the mobile device. The width and the height of the images are scaled proportionally to preserve the aspect ratio of the image and the integrity of the data contained within the images. In this embodiment, the maximum image size is related to the width of each image, wherein the maximum width is the width of the screen on the mobile device. After the maximum image size is determined, processing moves to block 406.

At block 406, the non-linear scale factor for the images is set. In one embodiment, the non-linear scale factor is set such that the largest image is scaled to a width that matches or is slightly smaller than the maximum image size. Since the maximum image size corresponds to the screen width, the non-linear scale factor is set so that the width of the largest image matches the width of the screen on the mobile device or is slightly smaller. For example, a maximum image size is 200 pixels in width, corresponding to the width of the screen on the mobile device. The non-linear scale factor is set such that each image, once scaled, has a width that is equal to or less than 200 pixels. Accordingly, larger images, that may be larger than the maximum image size after scaling, are forced to scale further to meet maximum image size limitation. For example, a 1000 pixel wide image that is scaled to 250 pixels using a given scaling function is forced to scale down further to 200 pixels. Scaling the images to fit the width of a screen on a mobile device improves usability of the image by minimizing the horizontal scrolling required to view the image. Processing continues at decision block 408.

At decision block 408, a determination is made whether a zoom feature is associated with the mobile device. A zoom feature on a mobile device is a feature that allows the user to view the data on a page at a selected zoom setting. In one example, the zoom feature is used to change the default text size from smallest through to largest on a page of data. A different non-linear scale factor is applied for each zoom setting selected. For the smallest setting on the zoom feature, the user may desire more content to fit on the screen. The images may therefore be scaled more aggressively. Conversely, for the largest setting on the zoom feature, the user may want more detail on the images. Accordingly, the images are scaled to a lesser extent to attempt to preserve the original resolution of the image. If a zoom feature is present on the mobile device, processing moves to block 410.

At block 410, the non-linear scale factor is adjusted to compensate for the zoom setting. Once the non-linear scale factor is adjusted, processing moves to block 412, where the process returns to block 306 of process 300 shown in FIG. 3.

Alternatively, at decision block 408, if a zoom feature is not associated with the mobile device, processing moves to block 412 where processing returns to block 306 of process 300 shown in FIG. 3.

In one embodiment, the non-linear scale factor may be adjusted whenever the zoom setting is adjusted according to another process. For example, a user may select the smallest zoom setting, to have more content fit on the screen at any time after the image has already been scaled to fit the screen on the mobile device. The non-linear scale factor is therefore adjusted to more aggressively scale any images to reduce their size and accommodate the selection of the smallest zoom setting by the user.

In a further embodiment, a separate non-linear scaling factor is applied to each image according to the attributes of the image, including not scaling the image. For example, the content of the page of data may be examined to determine the type of image displayed. If a determination is made that the usability of the image will be compromised if the non-linear scale factor is applied, another scale factor may be used.

Figures 5A, 5B, 5C, 5D, 5E:
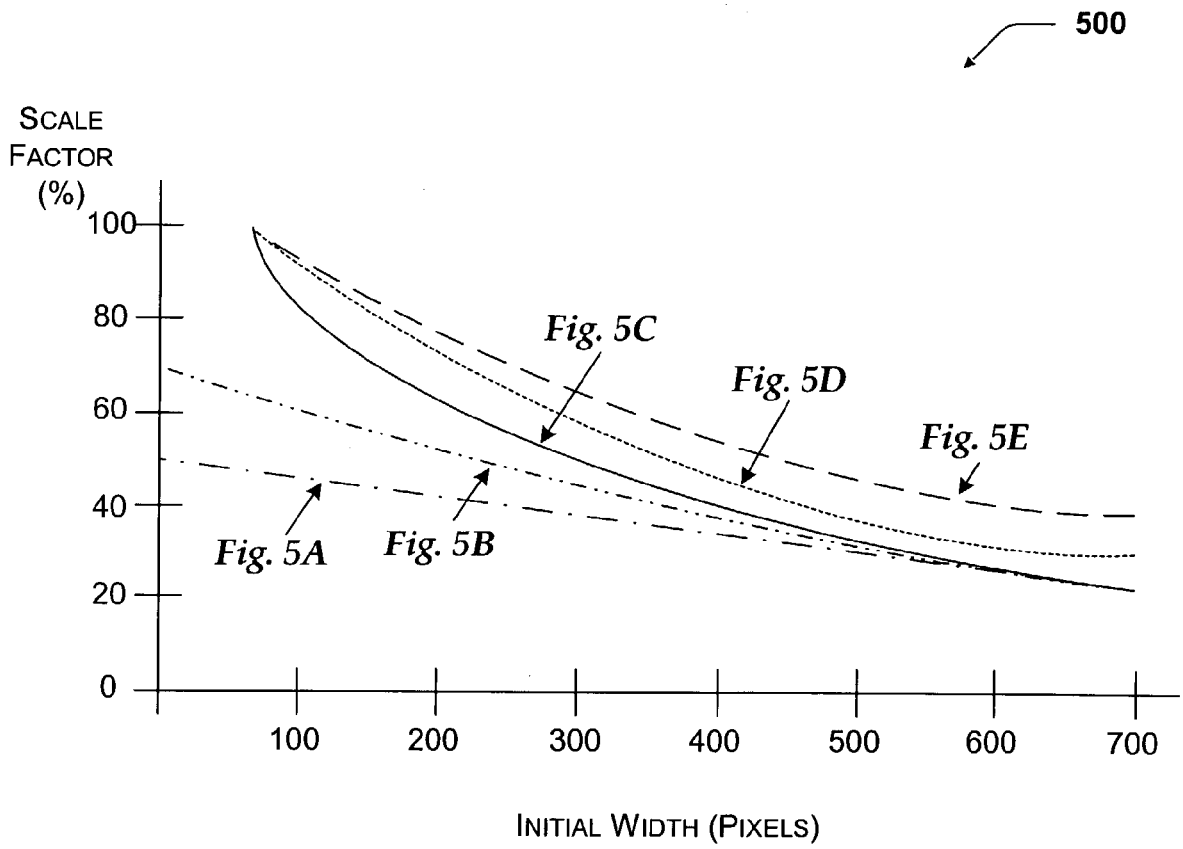
FIGS. 5A-5E are exemplary responses for different zoom settings that illustrate the non-linear scaling function of the present invention.

FIGS. 5A-5E are exemplary responses for different zoom settings that illustrate the non-linear scaling function of the present invention. The responses illustrate the non-linear scale factor percentage for five different zoom settings for the images (smallest, small, medium, large, largest) depending on the initial width (in pixels) of the images. As the scale factor percentage of an image decreases, the more aggressively the image is scaled. In the example shown, the width of the screen, or the maximum image size, is 200 pixels in width. FIG. 5A corresponds to the response for a "smallest" zoom setting. FIG. 5B corresponds to the response for a "small" zoom setting. FIG. 5C corresponds to the response for a "medium" zoom setting. FIG. 5D corresponds to the response for a "large" zoom setting. FIG. 5E corresponds to the response for a "largest" zoom setting.

In the example shown, images for the medium, large, and largest zoom settings (FIGS. 5C-5E) are scaled from 100% for 1 pixel wide image, with the scale factor percentage gradually decreasing as the width of each image increases. Images corresponding to the small zoom setting (FIG. 5B) are scaled from 70%, with the scale factor percentage gradually decreasing as the width of the image increases. Images for the smallest zoom setting (FIG. 5A) are scaled from 50%, with the scale factor percentage gradually decreasing as the width of the image increases.

As previously stated in the discussion of FIG. 4, the smallest zoom setting (e.g., FIG. 5A) is selected when the user desires more content to fit on the screen. Accordingly, the images may are scaled more aggressively (e.g., lower scale factor percentage) for the smallest zoom setting. Conversely, for the largest zoom setting (e.g., FIG. 5E) the user desires more detail on the images. Accordingly, the images are scaled to a lesser extent (e.g., higher scale factor percentage) to attempt to preserve the original resolution of the image.

Figures 6A, 6B, 6C, 6D, 6E:
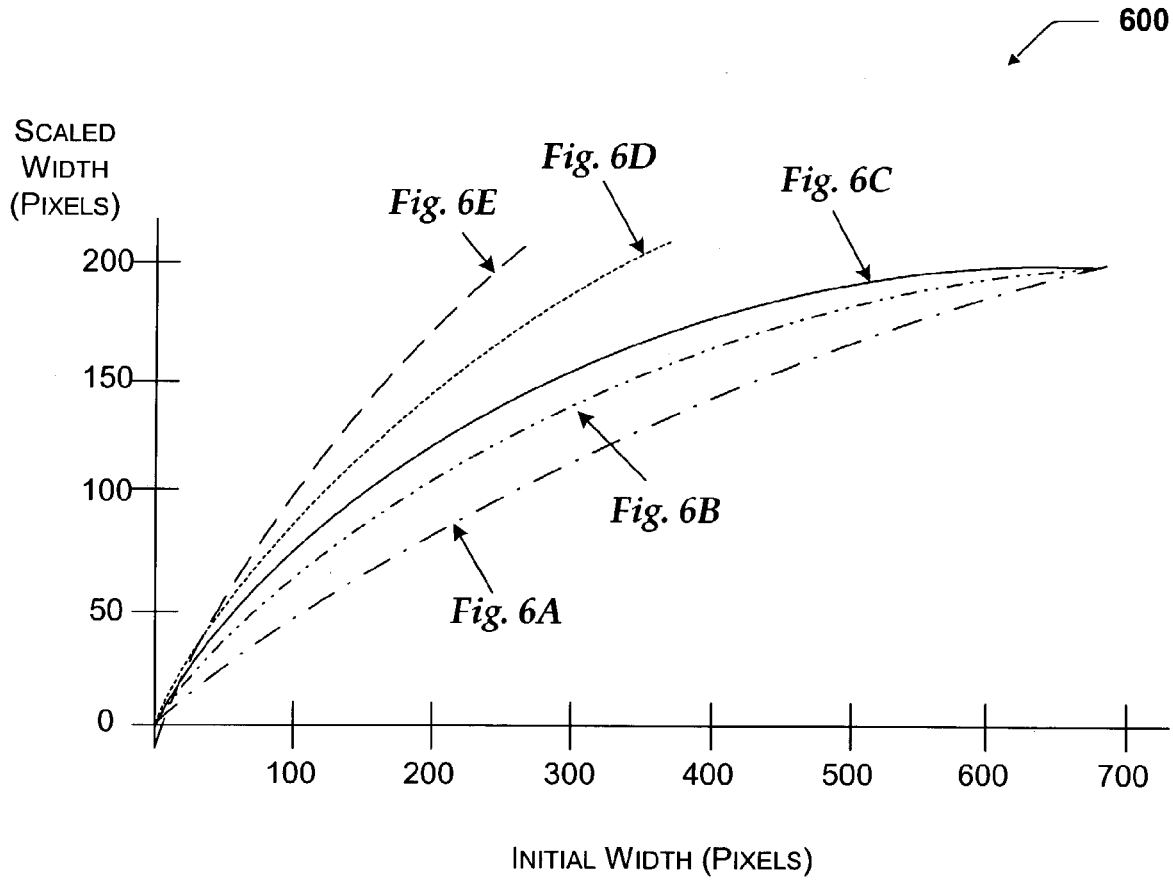
FIGS. 6A-6E are further exemplary responses for different zoom settings that additionally illustrate the non-linear scaling function of the present invention.

FIGS. 6A-6E are further exemplary responses for different zoom settings that additionally illustrate the non-linear scaling function of the present invention. The responses illustrate the scaled width (in pixels) for images corresponding to five zoom settings (smallest, small, medium, large, largest) depending on the initial width (in pixels) of the images. In the example shown, the width of the screen, or the maximum image size, is 200 pixels in width. FIG. 6A corresponds to the response for a "smallest" zoom setting. FIG. 6B corresponds to the response for a "small" zoom setting. FIG. 6C corresponds to the response for a "medium" zoom setting. FIG. 6D corresponds to the response for a "large" zoom setting. FIG. 6E corresponds to the response for a "largest" zoom setting.

The images are scaled to a width of 200 pixels or less to correspond to the maximum image size. For the largest zoom setting (e.g., FIG. 6E), the scaled width of an image is 200 pixels when the initial width of the image is approximately 300 pixels or more. The scaled width of images for the largest zoom setting are therefore at a maximum width for the widest range of initial widths, ensuring larger sizes for the images. Conversely, images corresponding to the smallest zoom setting (e.g., FIG. 6A) do not reach a scaled width of 200 pixels until the initial width reaches approximately 700 pixels. The scaled width of images for the smallest zoom setting are therefore at a maximum width for a shortest range of initial widths, ensuring smaller sizes for the images.

The responses in FIGS. 5A-5E and FIGS. 6A-6E are representative of scaling images on a mobile device where a variety of zoom setting are used. As previously stated, in other embodiments, a zoom feature may not be associated with the mobile device. FIGS. 5A-5E and FIGS. 6A-6E remain representative of the use of a non-linear scale factor to scale images associated with a page of data on a mobile device. Examining the figures, images that have a larger initial width are scaled more aggressively than those images with a smaller initial width. That a difference is present between images with a larger initial width in comparison to images with a smaller initial width is independent of the zoom setting used. The difference illustrates the use of a non-linear scale factor for scaling the images of a page of data on a mobile device.

The above specification, examples and data provide a complete description of the method and use of the invention. Since many embodiments of the invention can be made without departing from the spirit and scope of the invention, the invention resides in the claims hereinafter appended.

We claim:

1. A computer-implemented method for scaling images on a web page to fit a screen on a mobile device, the method comprising:

receiving a web page that requires scaling to fit on a screen of a mobile device;

identifying a first image and a second image of the web page;

determining a first scale factor for the first image irrespective of the position of the first image of the web page, the first scale factor being dependent on an initial size of the first image and the width of the screen of the mobile device, the first scale factor decreasing non-linearly as the initial size of the first image increases;

determining a second scale factor for the second image irrespective of the position of the first image of the web page, the second scale factor being dependent on the initial size of the second image and the width of the screen of the mobile device, the second scale factor decreasing non-linearly as the initial size of the second image increases, wherein the first scale factor and the second scale factor are different;

determining whether a zoom feature is associated with the web page of the mobile device;

adjusting the first and the second scale factors when the zoom feature is associated with the web page, the adjusted first scale factor of the first image increasing non-linearly as a zoom setting of the web page increases and the adjusted first scale factor of the first image decreasing non-linearly as the zoom setting of the web page decreases, the adjusted second scale factor of the second image increasing non-linearly as the zoom setting of the web page increases and the adjusted second scale factor of the second image decreasing non-linearly as the zoom setting of the web page decreases;

automatically scaling the first image associated with the web page according to the first adjusted scale factor and automatically scaling the second image associated with the web page according to the second adjusted scale factor; and displaying the first image and the second image on the screen of the mobile device.

2. The computer-implemented method of claim 1, wherein determining the first and second scale factors further comprises determining a maximum image size for the images on the web page, wherein the maximum image size corresponds to a width associated with the screen.

3. The computer-implemented method of claim 2, wherein scaling the first and the second image further comprises scaling each image such that a width associated with a largest image on the web page substantially corresponds to the maximum image size.

4. The computer-implemented method of claim 1, wherein a selected one of the first and the second images has a width such that scaling the selected one of the first and the second images is avoided.

5. The computer-implemented method of claim 1, wherein a selected one of the first and the second images has an attribute such that the selected one of the first and second images is scaled according to another scale factor.

6. The computer-implemented method of claim 1, wherein the first and second images are scaled such that each of the first and second images have a width that is less than or equal to the width of the screen on the mobile device, whereby horizontal scrolling is minimized.

7. A mobile device, comprising:

a processor;

a display that includes a screen;

a memory into which a plurality of computer-executable instructions are loaded, the computer-executable instructions performing a method comprising:

receiving a web page that requires scaling to fit on a screen of a mobile device;

identifying a first image and a second image of the web page;

determining a first scale factor for the first image irrespective of the position of the first image of the web page, the first scale factor being dependent on an initial size of the first image and the width of the screen of the mobile device, the first scale factor decreasing non-linearly as the initial size of the first image increases;

determining a second scale factor for the second image irrespective of the position of the second image of the web page, the second scale factor being dependent on the initial size of the second image and the width of the screen of the mobile device, the second scale factor decreasing non-linearly as the initial size of the second image increases, wherein the first scale factor and the second scale factor are different;

determining whether a zoom feature is associated with the web page of the mobile device;

adjusting the first and the second scale factors when the zoom feature is associated with the web page, the adjusted first scale factor of the first image increasing non-linearly as a zoom setting of the web page increases and the adjusted first scale factor of the first image decreasing non-linearly as the zoom setting of the web page decreases, the adjusted second scale factor of the second image increasing non-linearly as the zoom setting of the web page increases and the adjusted second scale factor of the second image decreasing non-linearly as the zoom setting of the web page decreases;

automatically scaling the first image associated with the web page according to the first adjusted scale factor and automatically scaling the second image associated with the web page according to the second adjusted scale factor; and displaying the first image and the second image on the display of the mobile device.

8. The mobile device of claim 7, the computer-executable instructions further comprising determining a maximum image size for the first image, wherein the maximum image size corresponds to a width associated with the screen of the mobile device.

9. The mobile device of claim 8, the computer-executable instructions further comprising scaling the first image such that a width associated with the first image substantially corresponds to the maximum image size.

10. The mobile device of claim 7, the computer-executable instructions further comprising avoiding scaling the first and the second image when an initial width associated with the first and the second image is less than a width associated with the screen.

11. The mobile device of claim 7, the computer-executable instructions further comprising scaling at least one of the first and a second image according to another scaling factor when the at least one of the first and second images has an associated attribute, wherein the attribute is such that scaling at least one of the first and second images according to one of the first and second scale factors reduces the usability of the images.

12. A computer-readable storage medium encoded with computer-executable instructions for performing a method comprising:

receiving a web page that requires scaling to fit on a screen of a mobile device;

identifying a first image and a second image of the web page;

determining a first scale factor for the first image irrespective of the position of the first image of the web page, the first scale factor being dependent on an initial size of the first image and the width of the screen of the mobile device, the first scale factor decreasing non-linearly as the initial size of the first image increases;

determining a second scale factor for the second image irrespective of the position of the second image of the web page, the second scale factor being dependent on the initial size of the second image and the width of the screen of the mobile device, the second scale factor decreasing non-linearly as the initial size of the second image increases, wherein the first scale factor and the second scale factor are different;

determining whether a zoom feature is associated with the web page of the mobile device;

adjusting the first and the second scale factors when the zoom feature is associated with the web page, the adjusted first scale factor of the first image increasing non-linearly as a zoom setting of the web page increases and the adjusted first scale factor of the first image decreasing non-linearly as the zoom setting of the web page decreases, the adjusted second scale factor of the second image increasing non-linearly as the zoom setting of the web page increases and the adjusted second scale factor of the second image decreasing non-linearly as the zoom setting of the web page decreases;

automatically scaling the first image associated with the web page according to the first adjusted scale factor and automatically scaling the second image associated with the web page according to the second adjusted scale factor; and displaying the first image and the second image on the screen of the mobile device.

13. The computer-readable storage medium of claim 12, wherein each of the first and second images are scaled such that each of the first and second images have a width that is less than the width of the screen on the mobile device.

14. The computer-readable storage medium of claim 12, further comprising avoiding scaling the second image when an initial width associated with the second image is less than the width associated with the screen of the mobile device.

15. The computer-readable storage medium of claim 12, wherein at least one of the first and second images is scaled according to another scaling factor when at least one of the first and second images is a type such that scaling at least one of the first and second images according to the scaling factor reduces its usability.

* * * * *